United States Patent [19]

Good

[11] Patent Number: 4,890,809

[45] Date of Patent: Jan. 2, 1990

[54] FOLDED HANG TAB

[75] Inventor: David M. Good, Peachtree City, Ga.

[73] Assignee: Voxcom, Inc., Peachtree City, Ga.

[21] Appl. No.: 218,267

[22] Filed: Jul. 13, 1988

[51] Int. Cl.[4] ..... A47H 1/10

[52] U.S. Cl. ..... 248/317; 206/284; 211/59.1; 248/340

[58] Field of Search ..... 248/317, 339, 340; 211/57.1, 59.1; 206/461, 460, 466, 284, 469; 229/DIG. 6

[56] References Cited

U.S. PATENT DOCUMENTS

| | | | |
|---|---|---|---|
| 3,289,831 | 12/1966 | Keating | 206/469 |
| 3,369,660 | 2/1968 | Hartman | 206/294 |
| 3,692,269 | 9/1972 | Hales | 248/339 X |
| 4,441,611 | 4/1984 | Sommariva | 206/460 X |
| 4,574,951 | 3/1986 | Weaver | 206/461 |
| 4,693,441 | 9/1987 | Conway | 248/225.1 |

FOREIGN PATENT DOCUMENTS

| | | | |
|---|---|---|---|
| 1371416 | 10/1974 | United Kingdom | 206/284 |

OTHER PUBLICATIONS

DO-IT Corporation, General Application Information Bulletin 105, 12/86.

*Primary Examiner*—J. Franklin Foss

*Attorney, Agent, or Firm*—Stonebraker, Shepard & Stephens

[57] ABSTRACT

A hang tab (10) is folded on itself, and its hanging region (15) is adhered to its stick-on region (20) so that it lies flat against a package (30) during shipment. The adhesive (25) between the hanging region and the stick-on region is arranged so that the hanging region can be unfolded after shipment to be upstanding from object (30), for hanging the object on a hanger wire. The adhesive bond can be made weak enough to break when the hanging region (15) is unfolded, or the bond can be stronger and can adhere an opening flap (16) to stick-on region (20) so that the unfolded hanging region has an opening (26) ready to receive a hanger wire.

9 Claims, 3 Drawing Sheets

FOLDED HANG TAB

BACKGROUND

Hang tabs are used for hanging packages and objects on the hanger wires of retail store displays. To do this, the hang tabs have a hanging region that is upstanding and formed with an opening to receive the hanger wire. Particularly when the objects or packages involved are rectangular, it is important for the upstanding hanging region to be folded against the object or package during shipment. Otherwise, the shipping carton holding the objects would have to provide free space for the upstanding tabs, and this would undesirably enlarge the shipping carton and loosen the packages within it.

A hang tab made by the DO-IT Corporation of South Haven, Michigan, has addressed this problem with a tab having a U-shaped frame adhered to the package around a hanging region that can be bent 180° to an upstanding position for hanging up the package. This arrangement makes the hang tab larger than normal and consumes extra sheet resin material. Also, the material must be especially tough and strong to resist the stresses involved in bending the hanging region 180° from its original orientation.

I have devised a better solution to this problem, using a smaller tab made of less expensive material. My hang tab is originally formed flat in the condition in which it will hang an object for display, but it is folded against itself until the object is to be hung and then it is unfolded to an upstanding position. It accomplishes this folding and unfolding with a normal sized hang tab that does not use additional material and does not require an especially strong, tough, or expensive material. This gives my folded hang tab a clear cost advantage.

SUMMARY OF THE INVENTION

My folded hang tab has a hinge line between a hanging region and a stick-on region so that the hanging region can be folded against and adhered to the stick-on region, until the hang tab is put to use. The adhesion of the hanging region to the stick-on region is arranged so that the hanging region can be unfolded from the stick-on region and raised to an upstanding position for hanging the object on a hanger wire. To accomplish this, the adhesive used can be a hot melt thermoplastic resin adhesive that does not bond strongly to the polyester resin sheet material that is preferred for the support strip of the hang tab. The adhesive bond can then be easily overcome to unfold the hanging region. The adhesive can also be applied to a die cut opening flap of the hanging region so as to bond the opening flap to the stick-on region. Then when the hanging region is unfolded, it breaks away from the opening flap, which can remain adhered to the stick-on region. Unfolding the hanging region separately from the folded opening flap automatically opens a wire hole in the hanging region. Either way, the unfolded hanging region returns to its original and unstressed position for hanging the object on a hanger wire.

DRAWINGS

DETAILED DESCRIPTION

Figure 1:
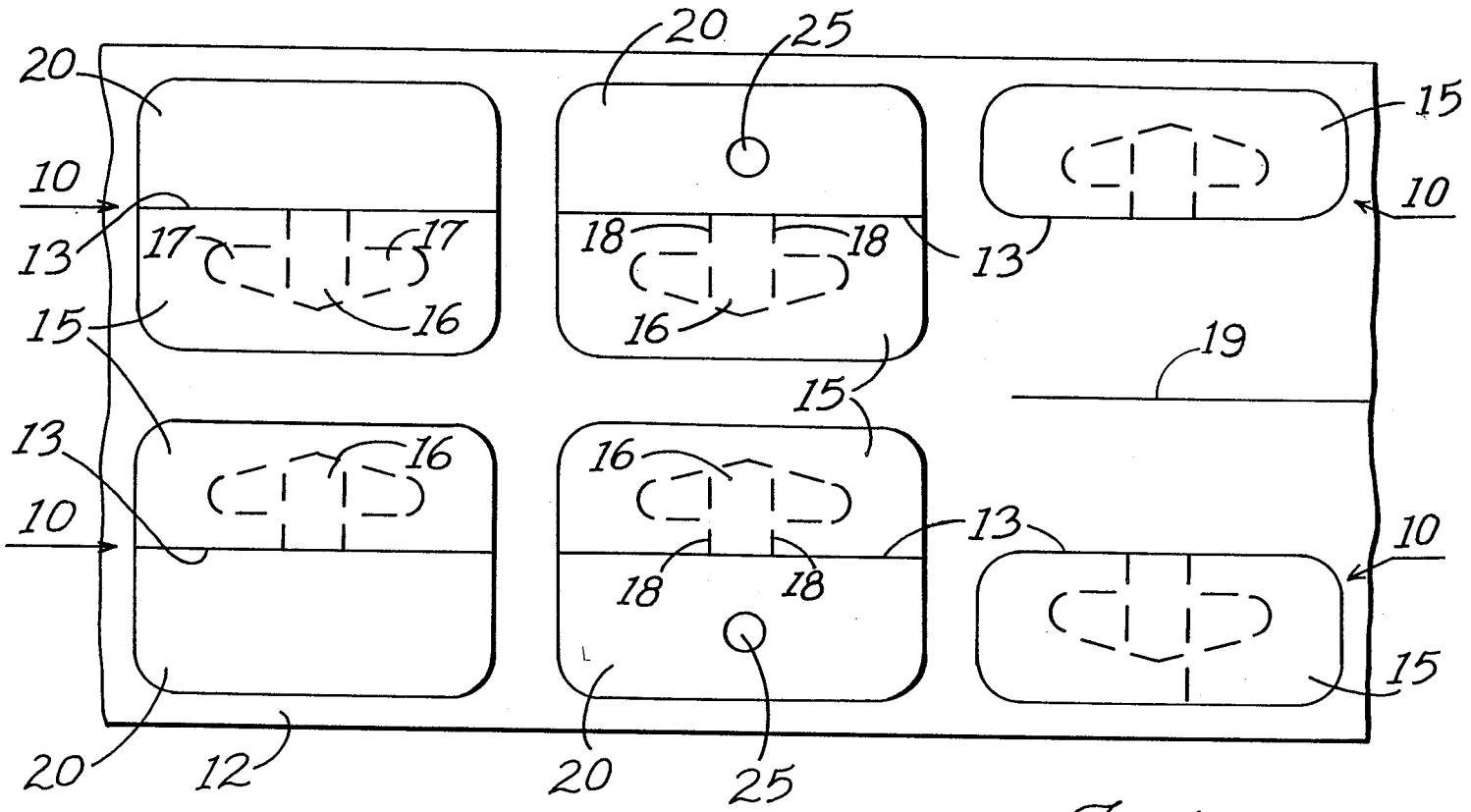
FIG. 1 is a plan view of a preferred embodiment of a hang tab made according to my invention, and showing, from left to right, pairs of tabs on a carrier strip as originally cut out, as provided with adhesive, and as folded for adhering to an object.

My hang tab 10 is folded and stuck to itself so that it lies flat, during shipment, against an object to which it is secured. A preferred way of making my folded hang tab is shown in FIG. 1.

Opposed pairs of hang tabs 10 are die cut from a preferably polyester resin support strip 11 (FIGS. 5–7) releasably carried on a carrier strip 12, which can be paper or resin. Each tab 10 has a hanging region 15, a stick-on region 20, and a hinge line 13 between these regions. Support strip 11 is flexible enough to bend along hinge line 13 so that hanging region 15 can be folded flat against stick-on region 20.

Figure 7:
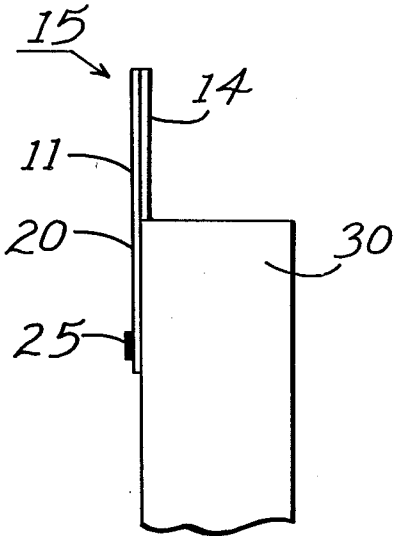
FIGS. 5–7 are side elevational views of the hang tabs and objects of FIGS. 2–4 respectively.
Figure 6:
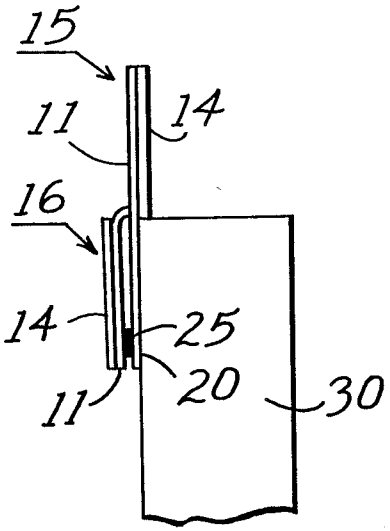
Figure 5:
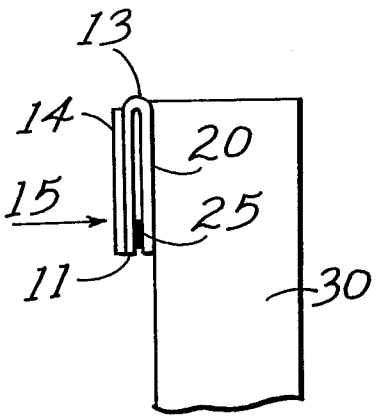

Although support strip 11 can be made strong enough to resist by itself the stresses imposed on hanging region 15, while hanging an object on a hanger wire, I prefer that hanging region 15 have a reinforcing laminate 14, as shown in FIGS. 5–7. There are several ways that reinforcing laminate 14 can be applied to hanging region 15, and I prefer the ways suggested in my copending patent applications Ser. No. 193,667, IMPROVED WAY OF REINFORCING HANG TABS, and Ser. No. 193,767, LINER REINFORCED HANG TAB, the disclosures of which are hereby incorporated into this application by reference.

Hanging region 15 is die cut along an interrupted cut line around an opening that can be broken away from hanging region 15 and bent from the plane of hanging region 15 to receive a hanger wire. A flap 16 in a central portion of this opening can open to receive a single wire hanger, and side flaps 17 can open to receive a double wire hanger. There are many ways that opening flaps 16 and 17 can be formed, and I prefer the ways suggested in my copending patent application Ser. No. 161,490, HANG TAB FOR HANGING OBJECT ON SINGLE OR DOUBLE WIRE HANGER, the disclosure of which is hereby incorporated into this application by reference.

Adhesive 25 adheres hanging region 15 to stick-on region 20, when hanging region 15 is folded flat against stick-on region 20, as shown at the right side of FIG. 1. To do this, adhesive 25 can be applied to either stick-on region 20 or hanging region 15, and adhesive 25 can be placed in single spots, as illustrated, or in multiple spots or linear beads.

I prefer using a hot melt thermoplastic resin adhesive 25, which does not bond firmly to the polyester region material preferred for support strip 11. This ensures that the bond of adhesive 25 can readily be overcome, for unfolding hanging region 15. Other adhesives can also be used, and a suitable adhesive material and a suitable adhesive application must reliably hold hanging region 15 folded flat during shipment, but must readily release hanging region 15 for unfolding to hang up objects on display racks.

Figure 2:
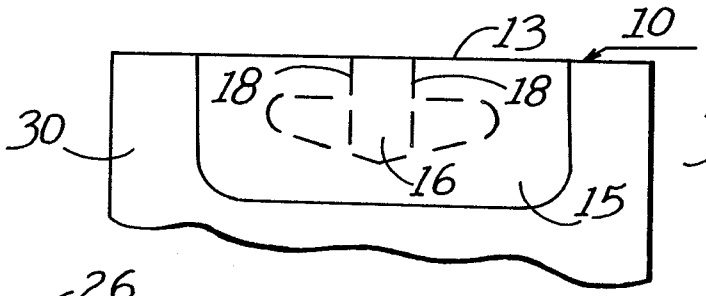
FIG. 2 is an elevational view of the folded hang tab of FIG. 1, applied to an object for shipping.
Figure 3:
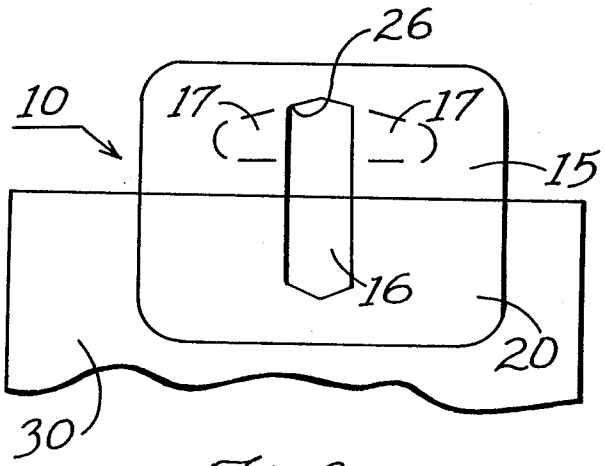
FIG. 3 is an elevational view of the hang tab and object of FIG. 2, with the hang tab unfolded for hanging.

In the embodiment of hang tab 10, shown in FIGS. 1–3, I apply adhesive spot 25 to bond opening flap 16 of hanging region 15 to stick-on region 20. I also extend the die cut lines along the sides of opening flap 16 by a pair of lines 18 that extend to hinge line 13. This allows opening flap 16 to open from hinge line 13 outward into hanging region 15. Before hanging region 15 is unfolded, though, interruptions in die cut lines 18 keep opening flap 16 in the plane of hanging region 15, which is thereby adhered, in its folded position, against stick-on region 20.

The two rows of tabs 10 that are folded and adhered to themselves are separated from each other by a cut line 19 dividing carrier strip 12 into two strips, each bearing a single row of folded hang tabs 10. The stick-on regions 20 of folded tabs 10 are transferred from carrier strip 12 and permanently adhered to packages or objects 30, as shown in FIGS. 2 and 5. A folded tab 10 then lies flat against a surface of object 30 during shipment.

When a shipping carton of objects 30 is unpacked for hanging objects 30 on display wires, hang tabs 10 are unfolded, as shown in FIGS. 3 and 6. This leaves opening flap 16 adhered to stick-on region 20 so that when hanging region 15 is upstanding from object 30, a central opening 26 is opened and ready to receive a hanger wire. Uncut interruptions in the die cut line around opening flap 16 are broken as hanging region 15 is unfolded, so that opening flap 16 breaks free of hanging region 15 and is bent out of opening 26 as hanging region 15 is raised to its upstanding position. This saves the retail clerk the effort of opening flap 16 to hang tab 10 on a single wire. If a double wire hanger is used, the clerk presses hanging region 15 against it forcefully enough to break open side flaps 17.

Figure 4:
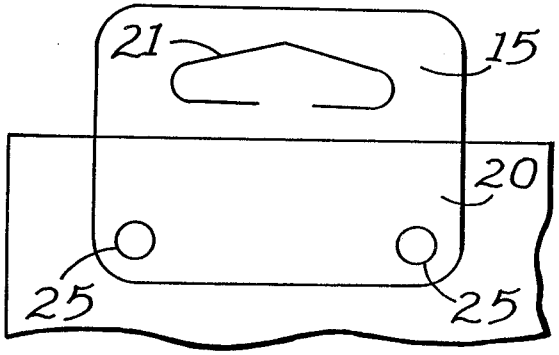
FIG. 4 is an elevational view of another form of folded hang tab, shown in an unfolded and upstanding position and showing an alternative location for adhesive.

Adhesive 25 need not make a permanent bond between stick-on region 20 and a portion of hanging region 15. This is illustrated in FIGS. 4 and 7, where two adhesive spots 25 remain on stick-on region 20 after releasing their bond to the corners of hanging region 15, which has been unfolded and raised to an upstanding position where it deploys a conventional die cut opening 21. A hot melt thermoplastic resin adhesive can accomplish this because of the weak bond it makes to the polyester resin material that is preferred for support strip 11.

Considering the many different ways that wire-receiving openings can be die cut in hanging region 15 and the many different ways that permanent or releasable adhesive bonds can be formed between folded hanging region 15 and stick-on region 20, there are a multitude of ways that my invention can be practiced. These may be also be varied with different materials, hanging region reinforcing laminates 14, and different packages or objects 30 to which the hang tabs are applied.

I claim:

1. A hang tab system for applying a foldable and unfoldable hang tab to an object that is hung up for display, said system comprising:

a. a single flat piece of resin material serving as a support strip of said hang tab, said support strip being divided between a stick-on region and a hanging region separated by a hinge line;

b. said stick-on region of said support strip being permanently adhered to a face of said object that is vertically oriented when said object is hung up for display;

c. said stick-on region being adhered to said object face in a position that disposes said hinge line along an upper region of said object at an upper end of said object face;

d. said support strip being folded approximately 180° along said hinge line between said stick-on region and said hanging region so that said hanging region is folded against said stick-on region and lies in a plane parallel with and adjacent to said stick-on region;

e. adhesive securing said hanging region to said stick-on region for holding said tab in folded condition against said object face during shipment; and f. said hanging region being unfoldable to an upstanding position after shipment, said hanging region in said upstanding position extending vertically upward from said stick-on region to a region above said object face, where said hanging region is deployed approximately in the plane of said stick-on region for hanging said object on a hanger wire.

2. The system of claim 1 wherein said opening flap extends to said hinge line, and said adhesive is placed on said flap to bond said flap to said stick-on region so that when said hanging region is unfolded to said upstanding position, said flap remains folded and bonded to said stick-on region to form an opening in said hanger region for receiving said hanger wire to hang up said object.

3. The system of claim 2 wherein said opening flap is formed by an interrupted die cut extending to said hinge line so that said die cut is broken open when said hanging region is unfolded.

4. The system of claim 1 wherein said adhesive adhering said hanging region to said stick-on region is releasable so that the bond of said adhesive is overcome when said hanging region is unfolded from said stick-on region for hanging up said object.

5. The system of claim 4 wherein said adhesive is a hot melt thermoplastic resin material.

6. In a hang tab system having a support strip extending between a stick-on region and a hanging region, said stick-on region being permanently adhered to an object face that is approximately vertical when said object is hung on a hanger wire for display, and said hanging region being vertically upstanding above said object face and having a die cut allowing an opening flap to be bent from the plane of said hanging region for receiving a hanger wire for hanging up said object, the improvement comprising:

a. said support strip being made of a single flat piece of resin material disposing said stick-on region and said hanging region in the same plane, said flat piece of resin material being folded approximately 180° along a hinge line between said stick-on region and said hanging region so that said hanging region is folded flat against said stick-on region for shipment with said hanging region parallel with said stick-on region and lying in a plane adjacent the plane of said stick-on region;

b. adhesive interposed between said hanging region and said stick-on region for holding said hanging region in said folded condition against said stick-on region;

c. said hanging region being unfoldable from said stick-on region after shipment for raising said hanging region to an upstanding position where said hanging region is restored approximately to its original co-planar relationship with said stick-on region and extends above said object face for hanging said object on said hanger wire; and d. said adhesive adhering said hanging region to said stick-on region being releasable so that the bond of said adhesive is overcome when said hanging region is unfolded from said stick-on region for hanging up said object.

7. The improvement of claim 6 wherein said adhesive is a hot melt thermoplastic resin material.

8. In a hang tab system having a support strip extending between a stick-on region and a hanging region, said stick-on region being permanently adhered to a face of an object that is approximately vertical when said object is hung on a hanger wire for display, and said hanging region being vertically upstanding from said vertical face of said object and having a die cut allowing an opening flap to be bent from the plane of said hanging region for receiving a hanger wire for hanging said object, the improvement comprising:

a. said support strip being made of a single flat piece of resin material disposing said stick-on region and said hanging region in the same plane, said flat piece of resin material being folded approximately 180°0 along a hinge line between said stick-on region and said hanging region so that said hanging region is folded flat against said stick-on region for shipment where said hanging region is parallel with said stick-on region and lies in a plane adjacent the plane of said stick-on region;

b. adhesive interposed between said hanging region and said stick-on region for holding said hanging region in said folded condition against said stick-on region;

c. said hanging region being unfoldable from said stick-on region after shipment for raising said hanging region to an upstanding position where said hanging region is restored approximately to its original co-planar relationship with said stick-on region and extends above said object face for hanging said object on said hanger wire; and d. said opening flap extending to said hinge line, and said adhesive being placed on said flap to bond said flap to said stick-on region so that when said hanging region is unfolded to said upstanding position, said flap remains folded and bonded to said stick-on region to form an opening in said hanger region for receiving said hanger wire to hang up said object.

9. The improvement of claim 8 wherein said opening flap is formed by an interrupted die cut extending to said hinge line so that said die cut is broken open when said hanging region is unfolded.

* * * * *